US005385453A

United States Patent [19]

Fogt et al.

[11] Patent Number: 5,385,453

[45] Date of Patent: Jan. 31, 1995

[54] MULTIPLE COMPRESSOR IN A SINGLE SHELL

[75] Inventors: James F. Fogt, Sidney; Jean-Luc Caillat, Dayton, both of Ohio

[73] Assignee: Copeland Corporation, Sidney, Ohio

[21] Appl. No.: 9,305

[22] Filed: Jan. 22, 1993

[51] Int. Cl.[6] ..... F04B 17/00

[52] U.S. Cl. ..... 417/410.5; 417/902

[58] Field of Search ..... 417/410 D, 248, 902

[56] References Cited

U.S. PATENT DOCUMENTS

| | | | |
|---|---|---|---|
| 3,126,713 | 3/1964 | Parker . | |
| 3,386,262 | 6/1968 | Hackbart et al. . | |
| 3,503,223 | 3/1970 | Parker . | |
| 3,602,611 | 8/1971 | Oplander . | |
| 4,105,374 | 8/1978 | Scharf . | |
| 4,108,581 | 8/1978 | Miller et al. . | |
| 4,205,537 | 6/1980 | Dubberley | 417/902 |
| 4,252,506 | 2/1981 | Hannibal . | |
| 4,277,955 | 7/1981 | Parker . | |
| 4,358,254 | 11/1982 | Hannibal . | |
| 4,396,360 | 8/1983 | Elson . | |
| 4,411,141 | 10/1983 | Hara . | |
| 4,591,318 | 5/1986 | Elson . | |
| 4,718,832 | 1/1988 | Takahashi . | |
| 4,744,737 | 5/1988 | Yamamura et al. . | |

FOREIGN PATENT DOCUMENTS

| | | |
|---|---|---|
| 63-97892 | 4/1988 | Japan . |
| 2-67494 | 3/1990 | Japan . |
| 3-71189 | 7/1991 | Japan . |
| 4-31684 | 2/1992 | Japan . |
| 4-109090 | 4/1992 | Japan . |
| 4-203380 | 7/1992 | Japan . |
| 4-93787 | 8/1992 | Japan . |

*Primary Examiner*—Richard A. Bertsch
*Assistant Examiner*—Alfred Basichas
*Attorney, Agent, or Firm*—Harness, Dickey & Perce

[57] ABSTRACT

A refrigerant compressor system utilizing a plurality of motor-compressors in a single shell in order to provide capacity modulation, wherein each motor-compressor is of the welded hermetic type having a minimum of modification, in order to take advantage of the low cost and optimized efficiency of such motor-compressors. Several related embodiments are also disclosed.

90 Claims, 9 Drawing Sheets

FIG. 13.
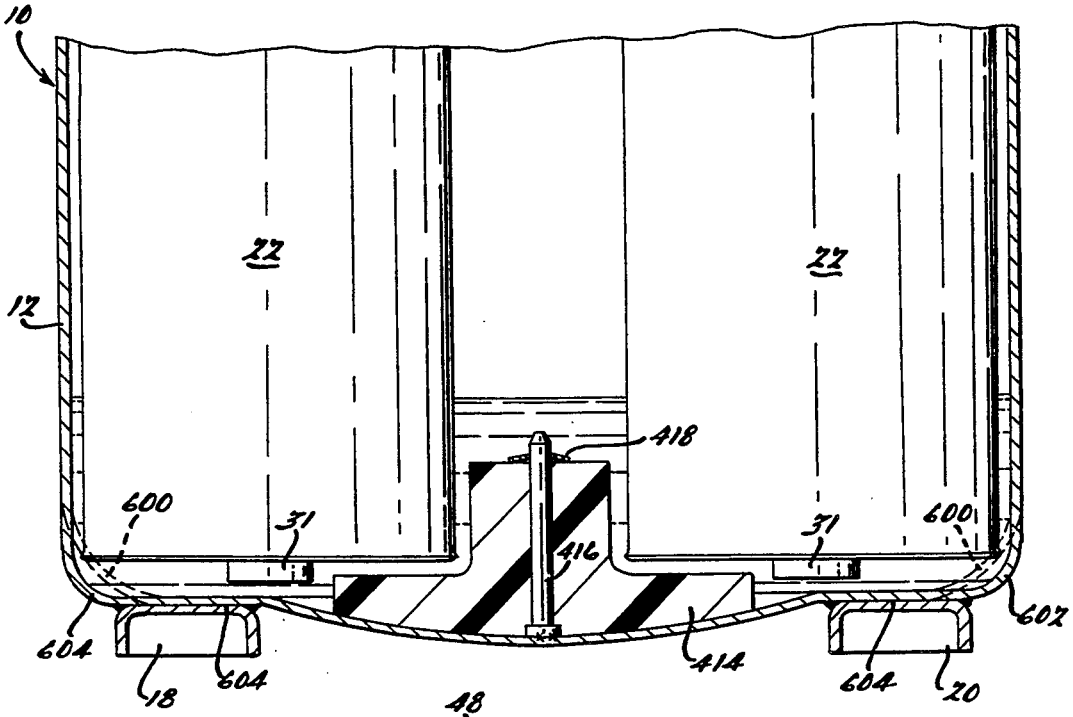
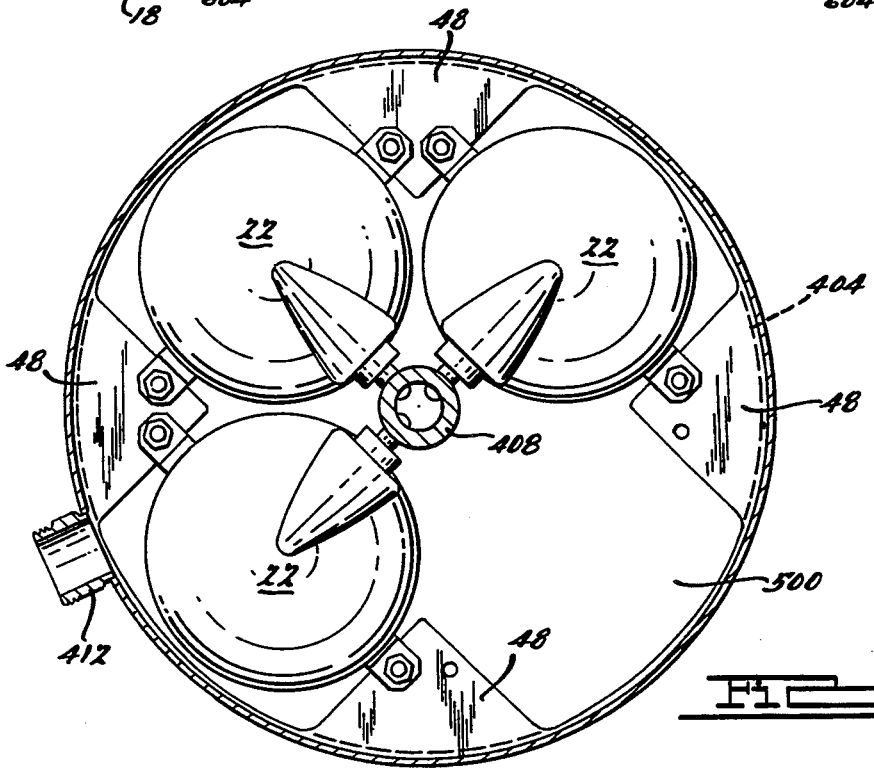
FIG. 12.

MULTIPLE COMPRESSOR IN A SINGLE SHELL

The present invention relates to refrigerant compressors, and more particularly to a hermetic compressor system which is capable of significant capacity modulation.

BACKGROUND AND SUMMARY OF THE INVENTION

In present times, when energy conservation is so important, there is a serious demand for refrigerant motor-compressor units which have an output which can be varied in accordance with demand. To this end, many different systems have been proposed. One such system involves the unloading of one or more cylinders in a multi-cylinder compressor, or the varying of re-expansion volume, for the purpose of varying output. Such systems tend to be relatively complex and the efficiency in the unloaded state is not optimum. Variable speed compressors have also been used, but they require expensive controls and also the speed control and motor-compressor efficiency present some short fall at least in a reduced output condition. Systems have also been employed incorporating, in place of a single compressor large enough to carry the maximum load, a plurality of smaller motor-compressors having a combined output equal to the required maximum, with means for controlling the total system in such manner as to selectively activate and deactivate less than all the compressors when it is desired to vary the output. Such systems have good efficiency but require complex hook-up plumbing, including means for dealing with lubricating oil management to assure that all the oil remains equally distributed between each of the compressors. Incorporation of a plurality of such smaller units in a single hermetic housing has also been proposed. For example, see assignees' U.S. Pat. Nos. 4,105,374 and 4,396,360. Such units, however, incorporated relatively complex and potentially troublesome spring suspensions, and also tended to be noisier than is now acceptable.

The present invention obviates the disadvantages of the aforementioned prior systems. In accordance with the present invention, a plurality of highly efficient motor-compressor units of the welded hermetic type, which are produced in large volume on automated production lines, are employed with a minimum amount of modification, arranged in the normal vertical position and relatively close together. A single sheet metal shell is fitted closely around all of the motor-compressors to maximize the compactness of the system and provide a common oil sump for equal oil distribution, a common suction gas inlet and a common discharge gas outlet. Noise and vibration are attenuated without the need for potentially troublesome and expensive spring suspensions. There are a number of different embodiments of the invention, each one having one or more improved features.

These and other features of the present invention will become apparent from the following description and the appended claims, taken in conjunction with the accompanying drawings.

BRIEF DESCRIPTION OF THE DRAWINGS

FIG. 12 is a view similar to FIG. 11 but illustrating a further embodiment of the present invention;

FIG. 13 is a fragmentary vertical sectional view somewhat similar to FIG. 1 but showing yet another embodiment of the present invention;

DESCRIPTION OF THE PREFERRED EMBODIMENT

Figure 1:
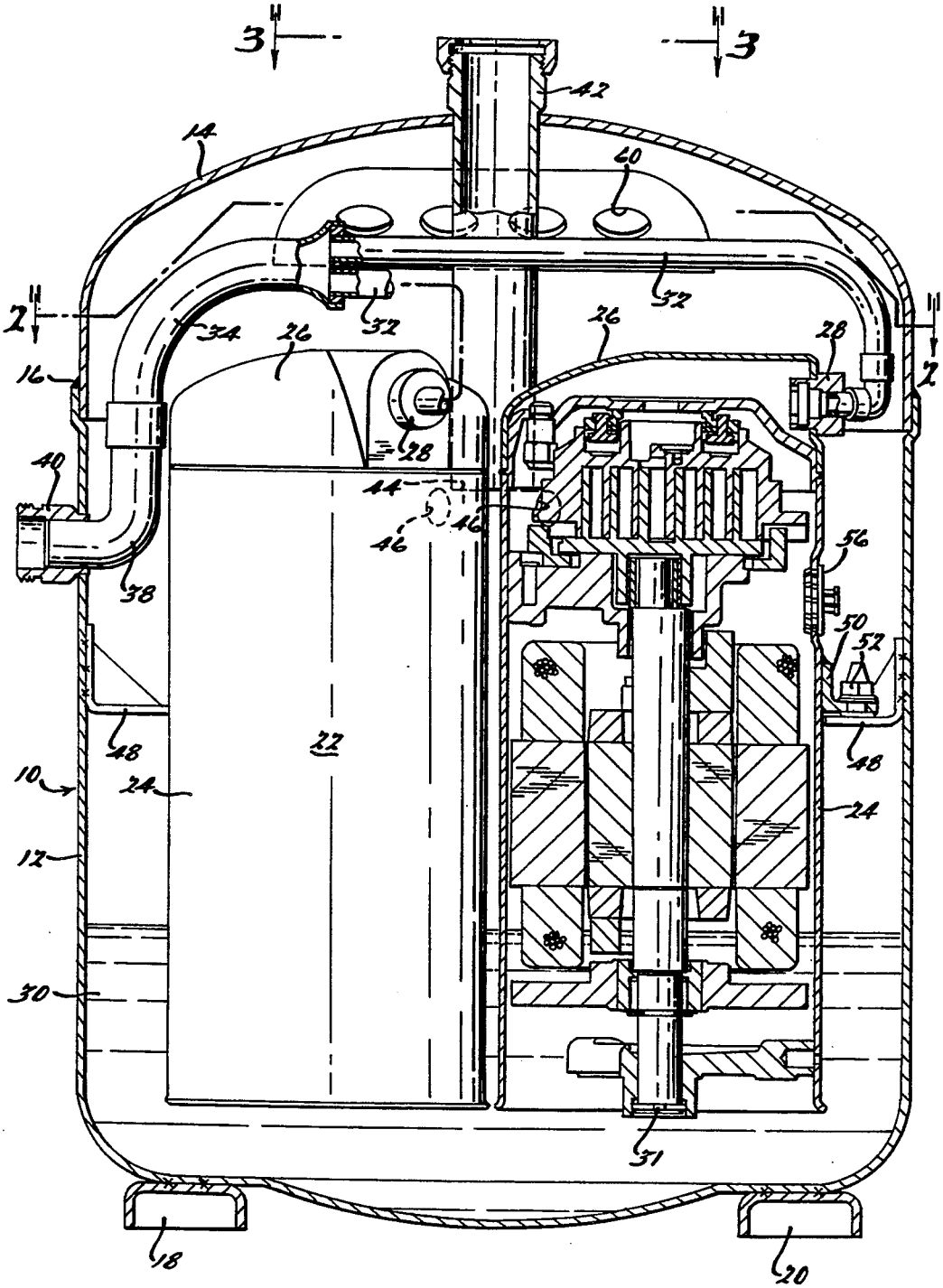
FIG. 1 is a vertical sectional view through a motor-compressor system embodying the principles of the present invention, taken generally along line 1—1 in FIG. 2.

The present invention is applicable to many different types of compressors, but for purposes of illustration it is shown in connection with the use of a rotary compressor of the scroll type. Preferably the compressors are of the welded shell hermetic type which are well known in the art.

The first embodiment of the invention is shown in FIGS. 1 through 4, and comprises an outer hermetic shell 10 comprising a lower shell wall portion 12 and an upper shell wall portion 14 of the configuration illustrated welded together at 16 to provide a fully hermetic enclosure. A pair of support legs 18 and 20 may be welded to the bottom in order to support shell 10. Disposed within shell 10 are a plurality (four in this embodiment) of vertically aligned, generally parallel hermetic type motor-compressors 22 disposed in a symmetrical side-by-side relationship. Each of the motor-compressors 22 is preferably a conventional motor-compressor of the desired type and capacity having as its only significant modification the elimination of the bottom end of the shell and fusite connector. The fact that the present invention can utilize compressors having a minimum of modification significantly reduces the cost of the overall system. Furthermore, the use of existing compressors means that the overall system has all of the original design benefits of these compressors in terms of optimized performance, efficiency and the like. The use of a shell within a shell is also believed to significantly reduce noise.

Each of the motor-compressors 22 comprises a major portion of its outer shell, including at a minimum a sheet metal side wall 24 which is in the form of a sleeve, to the upper end of which is attached, preferably by welding, an upper end wall 26 having a discharge fitting 28 extending therethrough. The lower end of side wall 24 is open as best shown in FIG. 1 and is disposed beneath the level of lubricating oil 30 disposed in a sump defined by the bottom of shell 10. This insures that the conventional oil pump 31 at the bottom of the motor-compressor is always submerged in oil. Because of the size of shell 10 the compressor system has a much higher than normal refrigerant charge limit.

The internal design of each of the motor-compressors 22 is not critical to the invention, dealing with the method of mounting same and the communciating of suction gases to and discharges from them are important. In the present embodiment there is shown a scroll compressor of the type disclosed in assignee's U.S. Pat. No. 5,102,316, the disclosure of which is hereby incorporated herein by reference.

Each discharge fitting 28 is connected to a discharge tube 32 which is in turn connected to a discharge manifold 34 having a flared inlet end in which is disposed a plate 36 having holes for receiving the ends of tubes 32. Manifold 34 in turn is connected via a tube 38 to a conventional discharge fitting 40 extending through the lower shell portion 12 of shell 10.

The upper portion 14 of shell 10 is provided with a centrally located axially extending suction inlet tube 42 having an outlet 44 disposed adjacent and substantially equidistant from suction inlet holes 46 formed in each of the sleeves 24, whereby suction gas may be introduced into the interior of the motor-compressors 22 where it is compressed in the normal manner.

Figure 2:
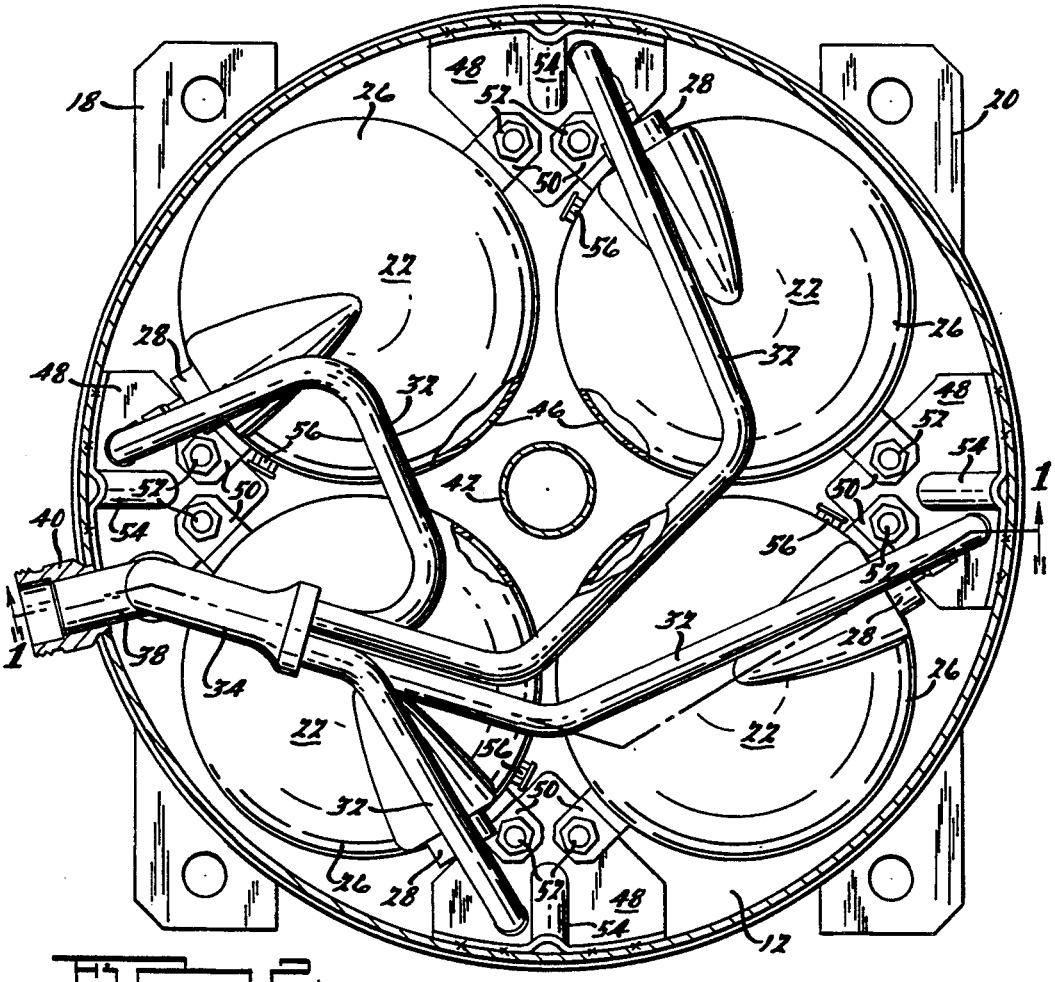
FIG. 2 is a transverse sectional view taken along line 2—2 in FIG. 1.

As best shown in FIG. 2, the four motor compressors 22 are mounted within shell 10 by means of four generally L-shaped brackets 48 which are of generally triangular shape in plan and which are welded to lower portion 12 of shell 10. Each bracket 48 rigidly supports two motor-compressors 22 and each motor-compressor 22 is supported by two diametrically opposed brackets 48. This supporting connection comprises generally a L-shaped mounting member 50 welded to each sleeve 24 and bolted by means of threaded fasteners 52 to an adjacent bracket 48. As can be seen, each sleeve 24 has two diametrically opposed mounting members 50. Preferably, each of the brackets 48 is disposed in the same horizontal plane which corresponds and intersects the center of gravity of each of the motor-compressors 22. This has been discovered to significantly reduce the vibration thereof by reducing the moment arms between the mass of the motor-compressor and the mounting plate. The overall layout of the components is best shown in FIG. 2 wherein it can be seen that there is very little wasted space. The shell 10 is preferably of circular cylindrical configuration and in order to have maximum strength for a minimum size, and motor-compressors 22 are closely nested therein with brackets 48 being disposed in the empty spaces between the motor-compressors and the shell. Each of the brackets 48 may be provided with a stiffening rib 54 if desired.

Figure 3:
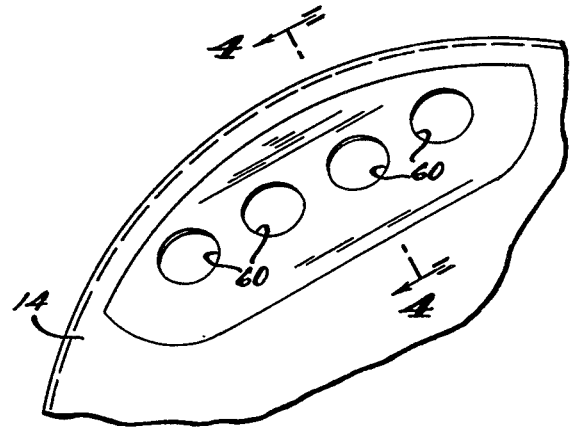
FIG. 3 is a fragmentary top plan view of a portion of the apparatus of FIG. 1, with certain parts removed.
Figure 4:
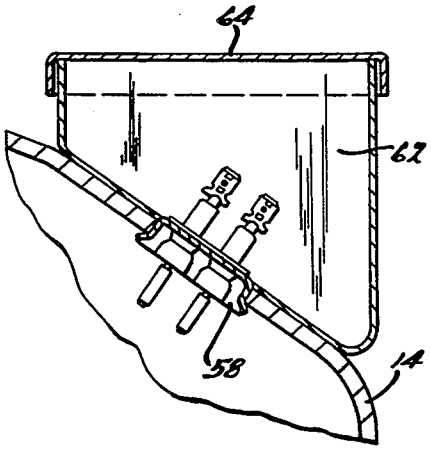
FIG. 4 is a sectional view taken substantially along line 4—4 in FIG. 3 but showing the parts not removed.

In order to obtain the desired capacity modulation of the overall system, it is necessary that each of the motor-compressors 22 be individually controlled by the external control for the entire system. The wires (not shown) which provide the power and control required extend from the motor portion of each motor-compressor 22 through a grommet 56 disposed in sleeve 24 (preferably in the hole which was originally provided for a fusite connector) and from grommet 56 to a fusite connector 58 mounted in an opening 60 in the upper portion 14 of shell 10. A separate hole 60 is provided for each fusite connector 58 and a separate fusite connector 58 is provided for each motor-compressor 22. FIGS. 1 and 3 show the holes in the shell without the fusite connector and FIG. 4 shows the fusite connector in place in which it is sealingly affixed to upper portion 14. On the outside of the shell the fusite connectors 58 are protected by an electrical box 62 having a removable cover 64 (FIG. 4).

Figure 5:
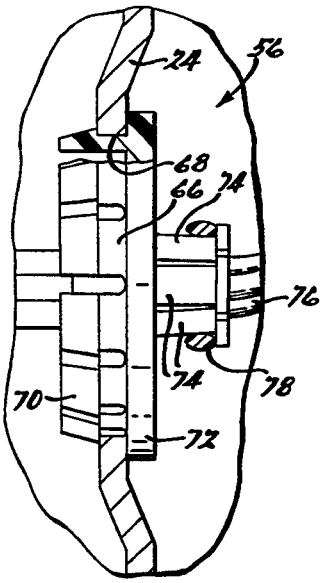
FIG. 5 is an enlarged fragmentary view of a grommet which is one of the novel features of the present invention.

Grommet 56 is best illustrated in FIG. 5 wherein it can be seen that it is formed of a suitable non-conductive polymeric material having a cylindrical annular body portion 66 disposed within an opening 68 in sleeve 24. The inner end of body 66 has a plurality of fingers 70 which compresses as the grommet is inserted and then snap apart to retain the grommet. Body 66 has an outer flange 72 which cooperates with fingers 70 to hold the grommet in place. Extending outwardly from flange 72 are a plurality of L-shaped fingers 74 defining an opening through which the wires (indicated at 76) extend. Fingers 74 are pulled together to snugly hold wires 76 in order to relieve the strain thereon within the motor-compressor (and to prevent slack from occurring in the motor-compressor) by means of a conventional nylon wire tie or "tie wrap" 78 disposed thereabout. The small projections at the free ends of fingers 74 prevent the tie wrap from slipping off the fingers.

Figure 6:
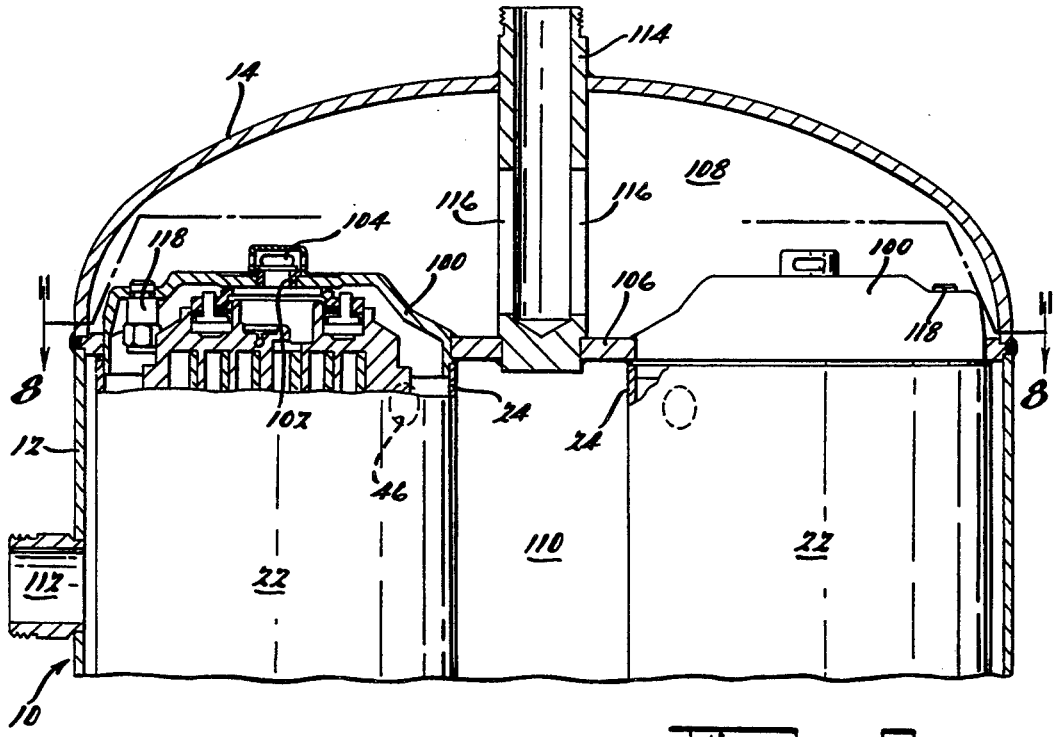
FIG. 6 is a partial vertical sectional view similar to FIG. 1 but showing the upper portion of another embodiment of the present invention.
Figure 7:
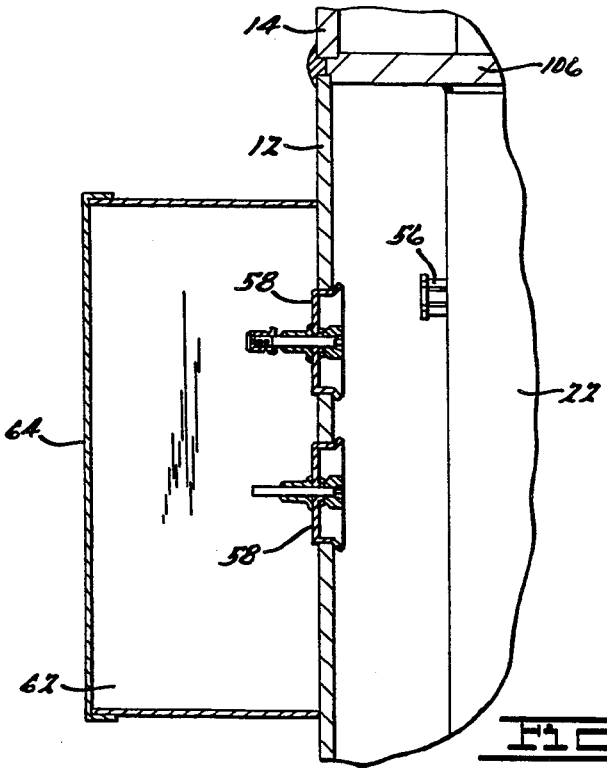
FIG. 7 is a fragmentary vertical sectional view of another portion of the apparatus of FIG. 6.
Figure 8:
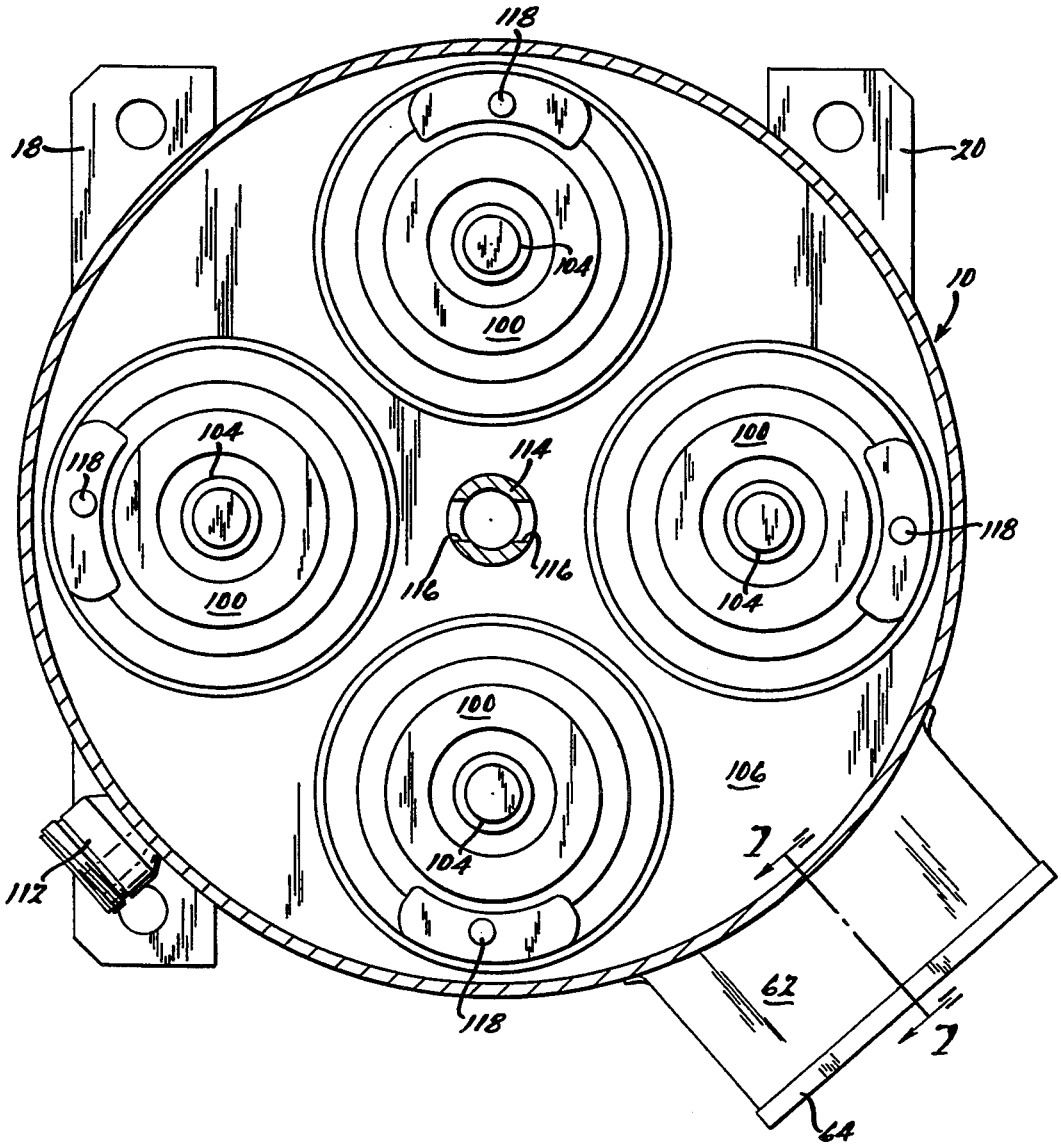
FIG. 8 is a sectional view taken substantially along line 8—8 in FIG. 6.

The next embodiment of the present invention is illustrated in FIGS. 6, 7 and 8, however, for an understanding of this embodiment it is necessary to describe generally a portion of the compressor being utilized. For purposes of simplicity, like numbers will be used for identical or similar parts for all of the embodiments. The upper end of the motor-compressor assembly includes a muffler plate 100 which extends all the way across sleeve 24 and is provided with a discharge port 102 in which may be disposed a suitable check valve 104. Note that in the FIG. 1 embodiment, the muffler plate 100 defined with upper end wall 26 is a discharge muffler which is in fluid communication with discharge fitting 28. In the present embodiment, the top shell end wall 26 is eliminated and each of the motor-compressors 22 is supported by means of a transversely extending plate 106 which is welded to outer shell 10 between lower portion 12 and upper portion 14 thereof. Plate 106 thus divides the interior of shell 10 into an upper common discharge plenum or muffler 108 and a lower volume 110 which is supplied suction gas by means of an inlet fitting 112 in shell wall 12. Each of the sleeves 24 will have a corresponding inlet opening for suction gas as in the previous embodiment. This is true of all the other details of construction of the motor-compressor. The top of shell portion 14 is provided with a centrally disposed discharge fitting 114 which extends downwardly to plate 106 and is affixed thereto to help stabilize and strengthen same, and is provided with transverse opening 116 which receive the discharge gas from the motor-compressors 22 and permit it to exit the shell.

Because the space above the motor-compressors is now at discharge pressure and temperature, the fusite connectors 58 are moved downwardly to the suction portion of the apparatus, as best shown in FIG. 7.

Each of the muffler plates 100 has extending therethrough a conventional IPR valve 118 which opens in the event there is excessive pressure differential between plenum 108 and the interior of the motor-compressor to permit gas at excessive pressure to pass downwardly into the suction side of the shell, in the course of which it should trip the conventional motor protector provided in the motor-compressor 22 in accordance with known techniques. This insures that the motor-compressor(s) which is (are) operating are deenergized.

Figure 9:
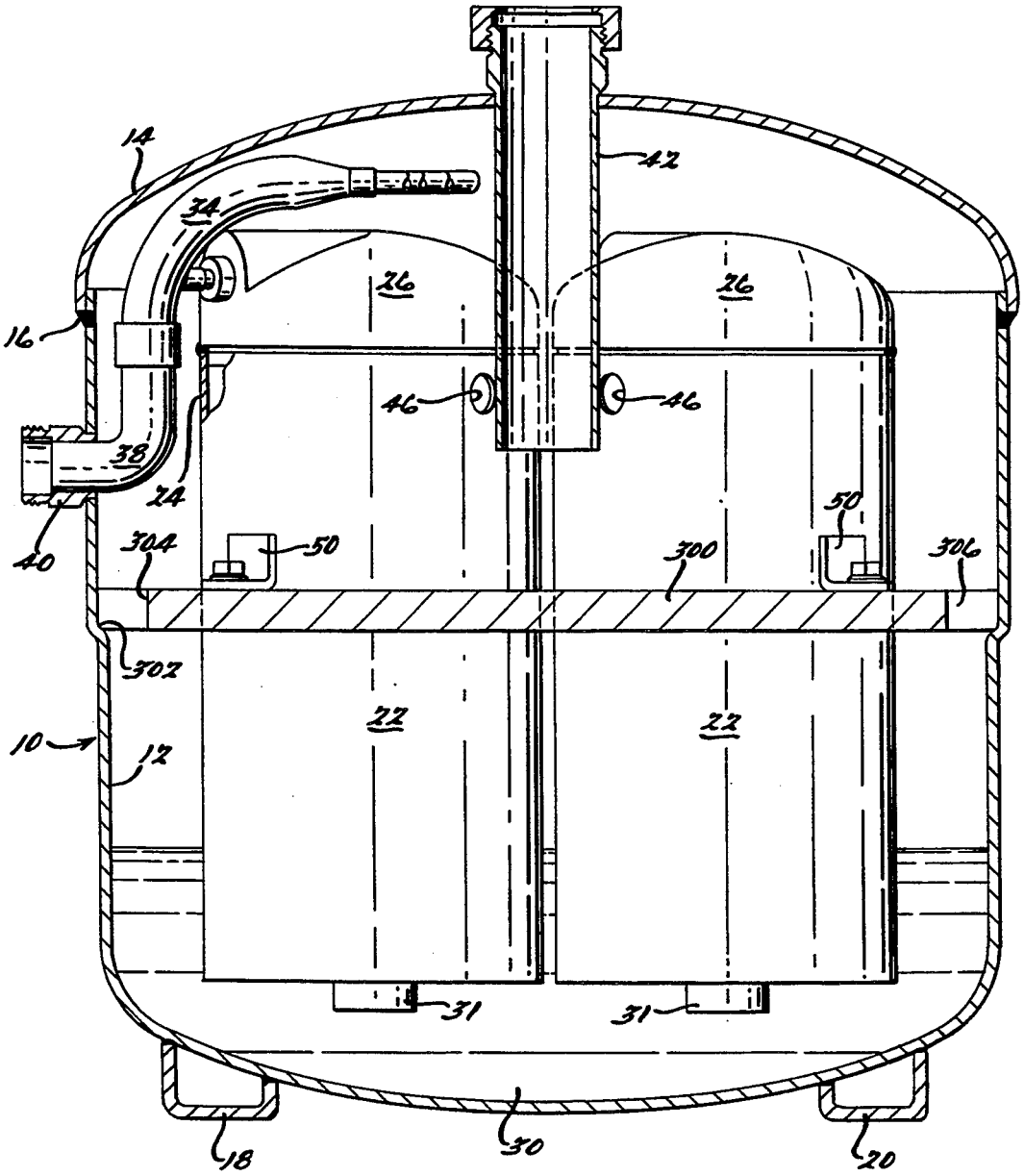
FIG. 9 is a vertical sectional view similar to FIG. 1 but showing yet another embodiment of the present invention.

The third embodiment is illustrated in FIG. 9. This embodiment is essentially the same as that of FIGS. 1 through 4 except that instead of using a plurality of brackets 48 to mount the individual motor-compressors 22, there is utilized a transversely extending metal plate 300 having a plurality of holes therein in each of which is disposed one of the motor-compressors 22. As in the earlier embodiment, each motor-compressor 22 is provided with a plurality of mounting brackets 50, a center of gravity level which in this case are bolted in a suitable manner to plate 300 in order to mount each motor-compressor. Plate 300 is supported within the lower portion 12 of shell 10 by means of a shoulder 302 in shell portion 12. In order to maintain balance pressures above and below plate 300 the latter may be provided with through openings 304 and 306 at the periphery thereof.

Figure 10:
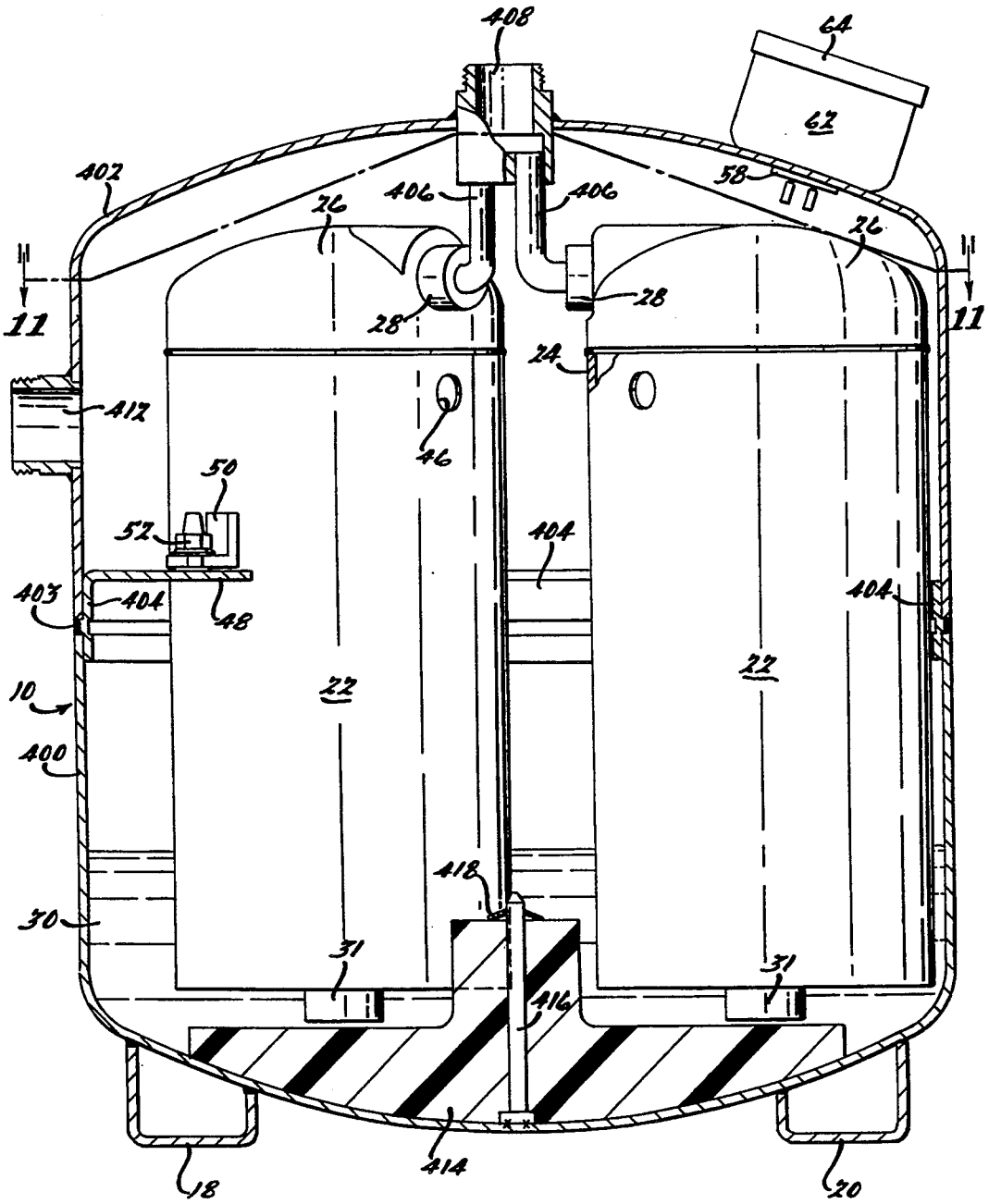
FIG. 10 is a vertical sectional view similar to FIG. 1 but showing yet a further embodiment of the present invention.
Figure 11:
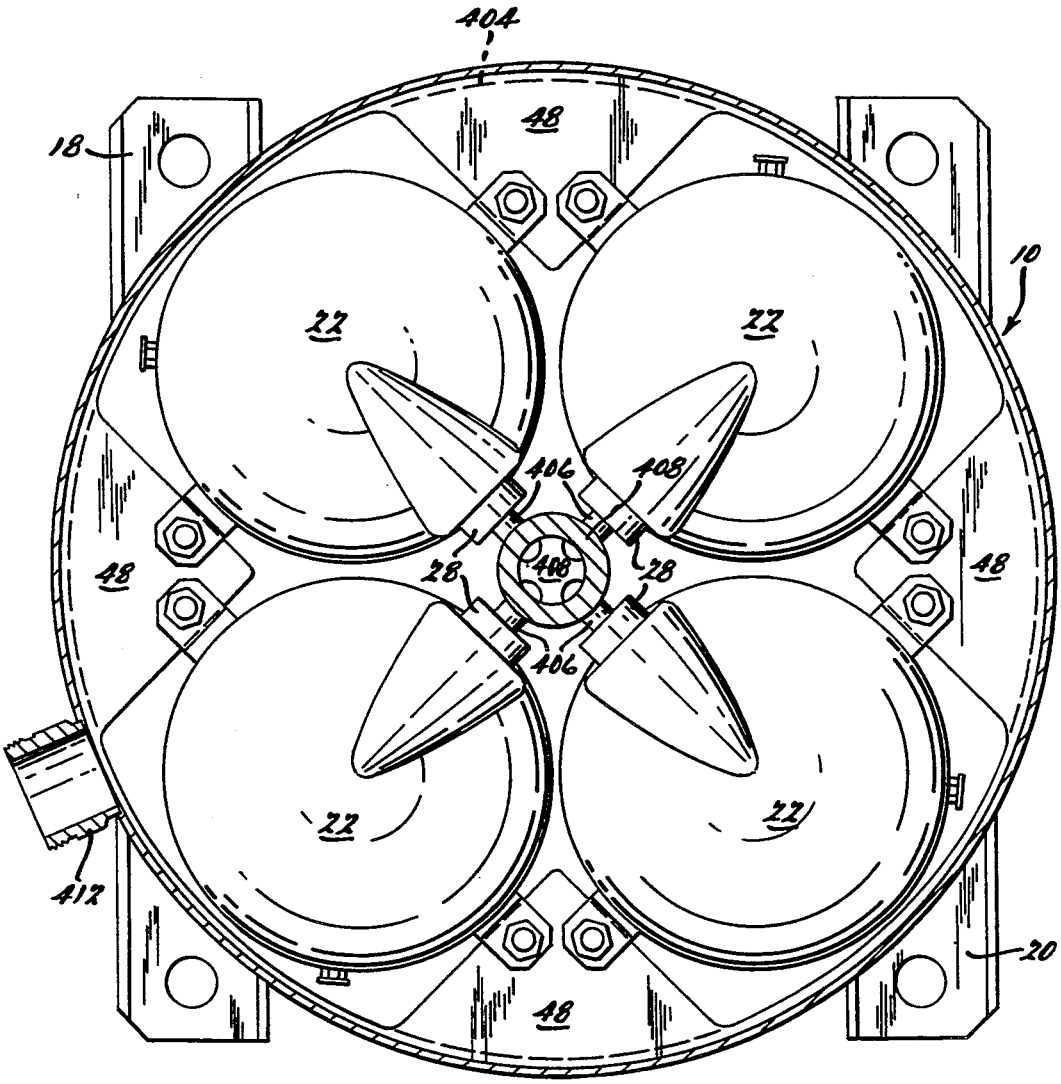
FIG. 11 is a sectional view taken substantially along line 11—11 in FIG. 10.

The next embodiment of the present invention is illustrated in FIGS. 10 and 11. This embodiment is generally the same as that of FIGS. 1 through 4, however, it embodies several features not found in the preceding embodiments. One of the features introduced by this embodiment is that outer shell 10 is comprised of a lower shell portion 400 and an upper shell portion 402, both of which are identical to one another. This obviously yields economies in manufacturing costs. Furthermore, at the point 403 the two shell portions 400 and 402 are welded together there is provided a continuous circumferential reinforcing band 404 which has integrally formed thereon brackets 48 for supporting each of the motor-compressors 22, utilizing brackets 50 and fasteners 52 as in the first embodiment. Again the fastening is at the level of the center-of-gravity of each of the motor-compressors to reduce vibration.

Another feature introduced in this embodiment is the provision of a short coupled discharge gas system comprising relatively short discharge tubes 406 of substantially equal length communicating from each of the discharge fittings 28 vertically upwardly into suitable bores in a discharge gas outlet fitting 408 centrally located in the top center of upper shell portion 402. Each of the discharge tubes 406 is telescopically received within fitting 408 and sealed by means of brazing or the like in order to facilitate assembly, (i.e. upper shell portion 402 can be simply vertically dropped over the remaining assembly and then welded in place). Alternatively, the fitting can be originally part of the upper shell with appropriate seals for telescopically receiving the discharge tubes upon assembly. The use of short discharge tubes reduces the amount of heat introduced inside the shell 10 by the temperature of the discharge gas, thus enhancing volumetric efficiency and reducing cost.

The interior of the shell is supplied suction gas via a suction inlet fitting 412 which extends through the wall of upper shell portion 402 and the gas within shell 10 flows into each of the motor compressors 22 through the previously described inlet opening 46.

Yet a further feature introduced by this embodiment is the provision of a filler or lubricant displacing member 414 disposed in the sump of shell 10 and held in place, for example, by means of a stud 416 welded to the bottom of the shell and extending upwardly through the member 414 and having at the upper end thereof a sheet metal fastener 418 to hold the member 414 in place. Member 414 can be of any suitable relatively inexpensive material which is impervious to oil, such as a closed cell foam or other polymetric material molded to the appropriate shape, or a casting of inexpensive metal. The shape of member 414 can vary with the assembly, but preferably it is of sufficient volume to reduce the quantity of oil contained in shell 10 to a more realistic amount which is consistent with the amount of oil required by each of the motor-compressors 22. As shown, member 414 projects upwardly between the motor-compressors 22 to accomplish this purpose.

A further embodiment of the invention is illustrated in FIG. 12. In this embodiment, which is believed to be self-explanatory from the drawing, the overall shell 10 is designed to contain and support four separate motor-compressors in the same manner as the previous embodiment, however, it is assembled and used with only three, thereby leaving an empty area 500 where there is no motor-compressor. This provides additional flexibility with respect to end applications where it is not necessary to have the degress of modulation provided by four separate compressors. Furthermore, if desired, the shell 10 can have the weld between portions 12 and 14 machined away and the top portion 14 then removed from the assembly, as can be easily visualized from FIG. 1. This would permit the later insertion, if desired, of a fourth motor-compressor in the empty space, after which top shell portion 14 would be rewelded in the manner illustrated.

The embodiment of FIG. 13 differs from the first embodiment primarily in that the bottom of shell portion 12 has been configured slightly differently in order to permit motor-compressors 22 to be mounted in a more lowered position, thereby reducing overall oil requirements. In addition, an oil displacing element 414 is provided. Specifically, the bottom corner of the shell is for the most part configured with the radius indicated at 600 which is substantially the same as that of the first embodiment. However, in each of the locations where a compressor is disposed, the lower corner of the shell (i.e., the intersection between the side wall and bottom end wall) is indented or formed downwardly so that it has a significantly smaller radius of curvature, as shown at 602, while at the same time also defining a flat pad surface 604 under each of the motor-compressors 22. These four flat pad surfaces (in the case of a unit containing four motor-compressors) are ideal locations to weld feet 18 and 20 too, thereby providing a very stable assembly.

Figure 14:
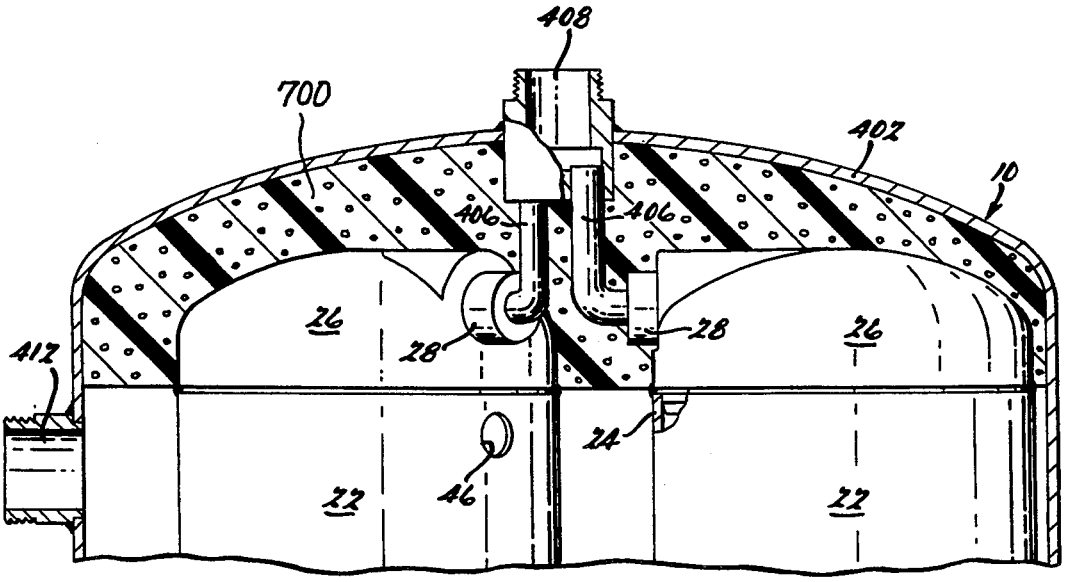
FIG. 14 is a fragmentary vertical sectional view similar to FIG. 10 but showing yet a further embodiment of the present invention.

The embodiment of FIG. 14 is the same as that of FIGS. 10 and 11 except that the upper interior portion of shell 10 is filled with a body of heat insulating material 700. Material 700 may be a pre-formed foam element molded to shape, or simply a blanket of heat insulating material draped over the hot muffler chambers and discharge gas tubes of each motor-compressor. The use of such material 700 further reduces heat transfer to the suction gas in the shell and thereby further increases efficiency.

Figure 15:
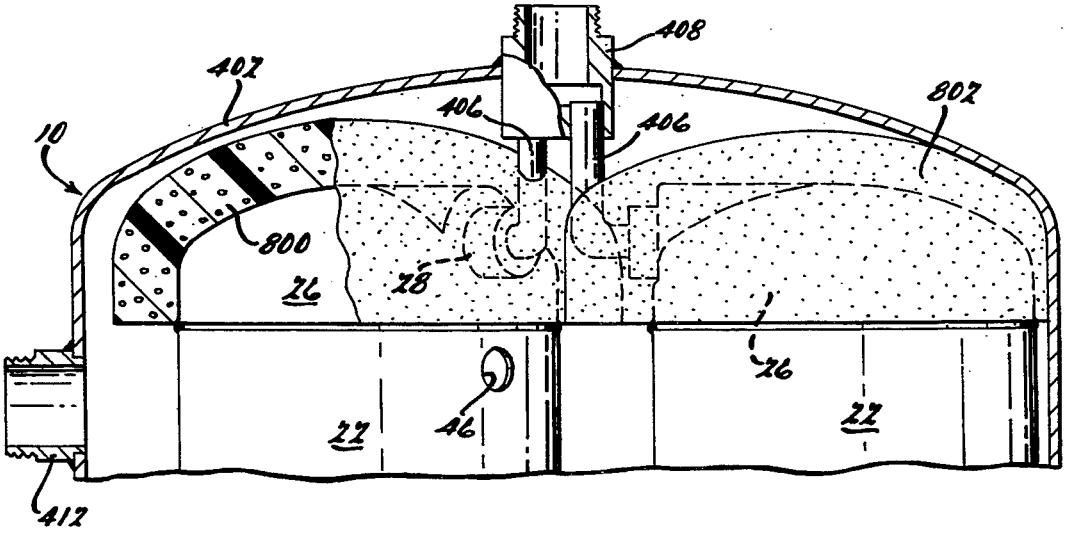
FIG. 15 is a fragmentary vertical sectional view similar to FIG. 14 but showing another embodiment of the present invention.

The embodiment of FIG. 15 is very similar to that of FIG. 14 except that instead of a single body of insulation, there are provided separate bodies of insulation 800 and 802 for each of the motor-compressors 22. Each of the bodies of insulating material may, as before, be either a pre-formed element molded to shape or simply a blanket of heat insulating material draped over the hot muffler chamber and having the discharge tube extending therethrough, the latter arrangement being what is shown in FIG. 15. The purpose and function of the insulation is exactly the same as that in the preceding embodiment.

In all of the embodiments described the motor-compressors and other design elements of the construction are the same as in the first embodiment or their equivalent unless described as being different. In addition, the individual motor-compressors can be operated or cycled in any desired manner in accordance with known criteria.

While it will be apparent that the preferred embodiments of the invention disclosed are well calculated to provide the advantages and features above stated, it will be appreciated that the invention is susceptible to modification, variation and change without departing from the proper scope or fair meaning of the subjoined claims.

We claim:

1. A variable capacity motor-compressor system comprising:

(a) a hermetic shell;

(b) a plurality of motor-compressors disposed in said shell, each of said motor-compressors including a motor and a compressor;

(c) a sheet metal sleeve surrounding and affixed to each of said motor-compressor compressors, each said sleeve substantially encompassing a motor, a compressor, and a discharge muffler; and (d) mounting means affixed to each of said sleeves for mounting each of said motor-compressors to said shell.

2. A motor-compressor system as claimed in claim 1 further comprising a sump of lubricating oil disposed in the bottom of said shell, said sump supplying lubricating oil to each of said motor-compressors.

3. A motor-compressor system as claimed in claim 2 wherein the lower end of each of said motor-compressors is disposed in said sump.

4. A motor-compressor system as claimed in claim 3 wherein each of said motor-compressors is of the hermetic type and said sleeve is the side wall of the hermetic shell encompassing each of said motor-compressors.

5. A motor-compressor system as claimed in claim 4 wherein each sleeve is open at the bottom to provide direct access to said sump.

6. A motor-compressor system as claimed in claim 4 wherein each motor-compressor hermetic shell is open at the top.

7. A motor-compressor system as claimed in claim 1 wherein there are at least three motor-compressors disposed in said shell.

8. A motor-compressor system as claimed in claim 1 wherein said motor-compressors are disposed generally parallel to one another.

9. A motor-compressor system as claimed in claim 1 wherein said motor-compressors are disposed in a side-by-side relationship.

10. A motor-compressor system as claimed in claim 9 wherein said motor-compressors are disposed generally parallel to one another.

11. A motor-compressor system as claimed in claim 1 wherein said motor-compressors are symmetrically arranged in said shell.

12. A motor-compressor system as claimed in claim 1 where said shell is of generally circular cylindrical configuration.

13. A motor-compressor system as claimed in claim 12 wherein said motor-compressors are symmetrically arranged in said shell.

14. A motor-compressor system as claimed in claim 1 wherein said shell has a side wall and said mounting means includes a bracket affixed to said shell side wall and to at least one of said sleeves.

15. A motor-compressor system as claimed in claim 14 herein said bracket is affixed to more than one of said sleeves.

16. A motor-compressor system as claimed in claim 14 wherein there are a plurality of said brackets.

17. A motor-compressor system as claimed in claim 16 wherein each bracket is affixed to two of said sleeves.

18. A motor-compressor system as claimed in claim 17 wherein each of said sleeves is affixed to two of said brackets.

19. A motor-compressor system as claimed in claim 14 wherein said bracket is welded to said shell and said sleeve has a projecting mounting member fastened to said bracket.

20. A motor-compressor system as claimed in claim 14 wherein said bracket is affixed to said sleeve substantially at the level of the center of gravity of the motor-compressor within said sleeve, whereby vibrations are reduced.

21. A motor-compressor system as claimed in claim 14 wherein the connection between said bracket and each said sleeve is relatively rigid.

22. A motor-compressor system as claimed in claim 14 wherein said shell is generally circular in horizontal cross-section and there are four vertical motor-compressors nested in a symmetrical generally parallel side-by-side relationship in said shell and wherein said mounting means includes four brackets, one disposed between and affixed to each adjacent pair of motor-compressors.

23. A motor-compressor system as claimed in claim 22 wherein each said bracket is generally triangular in plan, thereby facilitating a minimal diameter shell.

24. A motor-compressor system as claimed in claim 1 further comprising a common suction gas inlet port in said shell for supplying suction gas to all of the motor-compressors disposed in said shell.

25. A motor-compressor system as claimed in claim 24 further comprising a sump of lubricating oil disposed in the bottom of said shell, said sump supplying lubricating oil to each of said motor-compressors.

26. A motor-compressor system as claimed in claim 25 wherein the lower end of each of said motor-compressors is disposed in said sump.

27. A motor-compressor system as claimed in claim 26 wherein each of said motor-compressors has a suction gas inlet opening in its sleeve.

28. A motor-compressor system as claimed in claim 27 wherein each said inlet opening is sized so that during normal operation the pressure differential between the interior of said shell and the interior of said sleeve is no greater than approximately one inch of lubricating oil.

29. A motor-compressor system as claimed in claim 24 wherein each of said motor-compressors has a suction gas inlet opening in its sleeve.

30. A motor-compressor system as claimed in claim 29 wherein each of said inlet openings faces towards the center axis of said shell.

31. A motor-compressor system as claimed in claim 30 wherein said inlet port is connected to an inlet tube which extends along the center axis of said shell to a point approximately equidistant from each of said inlet openings.

32. A motor-compressor system as claimed in claim 29 wherein said shell is formed of an upper shell portion and a lower shell portion sealingly affixed thereto.

33. A motor-compressor system as claimed in claim 32 wherein said inlet openings are disposed in said lower portion of said shell and said inlet port is in said upper portion of said shell.

34. A motor-compressor system as claimed in claim 33 wherein each of said inlet openings faces towards the center axis of said shell.

35. A motor-compressor system as claimed in claim 34 wherein said inlet port is connected to an inlet tube which extends along the center axis of said shell to a point approximately equidistant from each of said inlet openings, thereby facilitating assembly of said system.

36. A motor-compressor system as claimed in claim 1 further comprising a separate fusite connector opening in said shell for each motor-compressor disposed therein, and a fusite connector disposed in each said opening and electrically connected to one of said motor-compressors, whereby each motor-compressor can be individually controlled from outside said shell to vary the capacity of said system.

37. A motor-compressor system as claimed in claim 36 wherein said wires to each motor-compressor pass through a hole in its sleeve, and further comprising a grommet disposed in said hole and surrounding said wires.

38. A motor-compressor system as claimed in claim 1 wherein said mounting means is affixed to said sleeve substantially at the level of the center of gravity of the motor-compressor within said sleeve, whereby vibrations are reduced.

39. A motor-compressor system as claimed in claim 1 wherein the connection between said mounting means and said sleeve is relatively rigid.

40. A motor-compressor system as claimed in claim 1 further comprising a common discharge gas outlet port in said shell for all of the motor-compressors disposed in said shell.

41. A motor-compressor system as claimed in claim 40 wherein each of said motor-compressors has a discharge gas fitting, and a discharge tube connecting each of said discharge gas fittings with said outlet port.

42. A motor-compressor system as claimed in claim 41 wherein said shell is formed of an upper shell portion and a lower shell portion sealingly affixed thereto.

43. A motor-compressor system as claimed in claim 42 wherein said discharge gas fitting is disposed in said upper portion of said shell, thereby facilitating assembly of said system.

44. A motor-compressor system as claimed in claim 41 wherein said motor-compressors are vertically disposed in a side-by-side arrangement and said discharge gas fitting is connected to a discharge manifold which extends above the level of said motor-compressors in said shell, said discharge tubes being connected to said discharge manifold.

45. A motor-compressor system as claimed in claim 1 wherein said mounting means is constructed to mount a predetermined number of motor-compressors in said shell, and wherein the total number of motor-compressors in said shell is less than said predetermined number.

46. A motor-compressor system as claimed in claim 45 wherein said predetermined number is four and said shell contains three motor-compressors.

47. A motor-compressor system as claimed in claim 1 wherein said mounting means is a plate extending across said shell, each of said motor-compressor being disposed in a hole in said plate, a plane of said plate passes through the approximate center of gravity of each of said motor-compressors.

48. A motor-compressor system as claimed in claim 47 wherein said plate sealingly divides the interior of said shell into a first chamber at suction gas pressure and a second chamber at discharge gas pressure.

49. A motor-compressor system as claimed in claim 48 wherein each of said motor-compressors is a rotary compressor disposed adjacent the top of its sleeve and having an upwardly disposed discharge port, each said motor-compressor being sealingly mounted to said plate with said discharge port positioned to discharge gas into said second chamber.

50. A motor-compressor system as claimed in claim 48 wherein each said motor-compressor has an IPR valve operable between said second chamber and the interior of said sleeve.

51. A motor-compressor system as claimed in claim 1 further comprising a sump of lubricating oil disposed in the bottom of said shell, said sump supplying lubricating oil to each of said motor-compressors, the lower end of each of said motor-compressors being disposed in said sump, said system further comprising an oil-displacing element disposed in said sump to reduce the quantity of oil needed to lubricate said motor-compressors.

52. A motor-compressor system as claimed in claim 51 wherein said element is in part disposed between said motor-compressors.

53. A motor-compressor system as claimed in claim 1 further comprising a common discharge gas outlet port in said shell for all the motor-compressors disposed in said shell, each of said motor-compressors having a discharge gas fitting, and a discharge tube connecting each of said discharge gas fittings with said outlet port, said motor-compressors being arranged in a side-by-side configuration with said outlet port being disposed centrally thereabove.

54. A motor-compressor system as claimed in claim 53 wherein each of said discharge tubes is of substantially the same length.

55. A motor-compressor system as claimed in claim 53 wherein said outlet port includes an outlet fitting, each of said discharge tubes being vertically telescopically disposed therein.

56. A motor-compressor system as claimed in claim 1 wherein said shell is formed of an upper portion and a lower portion sealingly affixed thereto, said upper and lower portions being identical to one another.

57. A motor-compressor system as claimed in claim 1 wherein said shell comprises a generally cylindrical side wall and a bottom wall with a radiused corner portion disposed therebetween, said corner portion having a first radius of curvature in the areas thereof close to said motor-compressors and a second radius of curvature in the areas thereof disposed between said motor-compressors.

58. A motor-compressor system as claimed in claim 57 wherein said first radius of curvature is less than said second radius of curvature so that said motor-compressors can be positioned closer to said bottom wall.

59. A motor-compressor system as claimed in claim 57 wherein said side wall, bottom wall and corner portion are integral with one another.

60. A motor-compressor system as claimed in claim 57 wherein said bottom wall is formed with a substantially flat surface adjacent each of said corner areas having said first radius of curvature.

61. A motor-compressor system as claimed in claim 60 further comprising shell supporting feet affixed to said flat surfaces.

62. A motor-compressor system as claimed in claim 1 wherein said shell has a side wall and said mounting means includes a plurality of brackets affixed to said side wall, each of said sleeves being affixed to two of said brackets.

63. A motor-compressor system as claimed in claim 1 further comprising a grommet for anchoring wires passing through a hole in said sheet metal sleeve comprising:

(a) a cylindrical annular body formed of a non-conducting material and having an outside diameter slightly less than that of said hole;

(b) an annular flange on one face of said body adapted to engage one surface of said sleeve;

(c) a plurality of flexible first fingers on the opposite face of said body having a relaxed diameter greater than the diameter of said hole but being compressible to fit through said hole, said fingers being adapted to snap apart and engage the opposite surface of said sleeve upon being inserted through said hole to thereby hold said grommet in position;

(d) a plurality of flexible second fingers extending outwardly from said flange and defining an opening through which wires are adapted to pass; and (e) closure means for clamping said second fingers against said wires to anchor same.

64. A grommet as claimed in claim 63 wherein said closure means is a tie wrap.

65. A grommet as claimed in claim 63 wherein each of said second fingers has a transverse projection at the end thereof to prevent said closure means from slipping off said second fingers.

66. A variable capacity motor-compressor system as claimed in claim 1 further comprising:

a separate fusite connector opening in said shell for each motor-compressors disposed therein, and a fusite connector disposed in each said opening and electrically connected to one of said motor-compressors, whereby each motor-compressor can be individually controlled from outside said shell to vary the capacity of said system.

67. A variable capacity motor-compressor system comprising:

(a) a hermetic shell;

(b) a plurality of motor-compressors disposed in said shell;

(c) a plurality of brackets each relatively rigidly affixed to said shell, each of which is disposed between a pair of adjacent motor-compressors; and (d) mounting means affixed to each of said motor-compressors for mounting each of said motor-compressors to a pair of said brackets.

68. A variable capacity motor-compressor system as claimed in claim 67 wherein each of said motor-compressors is relatively rigidly mounted to said shell.

69. A variable capacity motor-compressor system as claimed in claim 67 wherein each of said motor-compressors is positioned with its center-of-gravity disposed on a common plane, said bracket being disposed generally in said plane to reduce vibration of said motor-compressors in said shell.

70. A variable capacity motor-compressor system comprising:

(a) a hermetic shell;

(b) mounting means affixed to said shell for mounting a predetermined number of said motor-compressors in said shell; and (c) a plurality of motor-compressors disposed in said shell less in number than said predetermined number.

71. A variable capacity motor-compressor system as claimed in claim 1 further comprising:

means defining an opening in the bottom of each of the motor-compressor shells.

72. A motor-compressor system as claimed in claim 71 further comprising a sump of lubricating oil disposed in the bottom of said outer shell, said sump supplying lubricating oil to each of said motor-compressors.

73. A motor-compressor system as claimed in claim 72 wherein the lower end of each of said motor-compressors is disposed in said sump.

74. A variable capacity motor-compressor system comprising:

(a) a hermetic shell having a side wall which is of circular cylindrical configuration;

(b) at least three motor-compressors disposed in said shell; and (c) mounting means affixed to said shell for mounting each of said motor-compressors in a nested symmetrical relationship in said shell, thereby minimizing the overall diameter of said system.

75. A variable capacity motor-compressor system comprising:

(a) a hermetic shell;

(b) a plurality of motor-compressors disposed in said shell; and (c) a plate extending across said shell, each said motor-compressor being disposed in a hole in said plate and relatively rigidly affixed thereto, each said motor-compressor being positioned so that its center-of-gravity is located in approximately the same plane as said plate, whereby vibration of each of said motor-compressors in said shell is reduced.

76. A variable capacity motor-compressor system comprising:

(a) a hermetic shell comprising an upper portion having a peripheral edge and a lower portion having a peripheral edge, said edges being disposed adjacent one another;

(b) a circumferential band being contiguous with said peripheral edges and being joined to both of said shell portions to seal said shell;

(c) a plurality of motor-compressors disposed in said shell; and (d) mounting means affixed to said band for mounting each of said motor-compressors to said shell.

77. A motor-compressor as claimed in claim 76 wherein said mounting means is a plurality of brackets.

78. A motor-compressor as claimed in claim 76 wherein each of said shell portions is of the same shape.

79. A variable capacity motor-compressor system comprising:

(a) a hermetic shell;

(b) a plurality of motor-compressors mounted in said shell; and (c) a common discharge gas outlet port in said shell for all the motor-compressors disposed in said shell, each of said motor-compressors having a discharge gas fitting, and a discharge tube connecting each of said discharge gas fittings with said outlet port, said motor-compressors being arranged in a side-by-side configuration with said outlet port being disposed centrally thereabove, each of said discharge tubes being of substantially the same length.

80. A motor-compressor system as claimed in claim 79 wherein said outlet port includes an outlet fitting, each of said discharge tubes being vertically telescopically disposed therein.

81. A variable capacity motor-compressor system comprising:

(a) a hermetic shell;

(b) a plurality of motor-compressors mounted in said shell; and (c) a sump of lubricating oil disposed in the bottom of said shell, said sump supplying lubricating oil to each of said motor-compressors, the lower end of each of said motor-compressors being disposed in said sump; and (d) an oil element wholly independent of said motor-compressors, the element disposed in said sump to reduce the volume of said sump and hence the quantity of oil necessary to lubricate said motor-compressors.

82. A motor-compressor system as claimed in claim 81 wherein said element is in part disposed between said motor-compressors.

83. A variable capacity motor-compressor system comprising:

(a) a hermetic shell having a generally cylindrical side wall and a bottom wall with a radiused corner portion disposed therebetween;

(b) a plurality of motor-compressors mounted in said shell, each said motor-compressor being disposed in its own shell which is fully enclosed except at the bottom; and (c) mounting means for mounting each of said motor-compressors so that the lower end of each is disposed in said sump.

84. A motor-compressor system as claimed in claim 83 wherein said first radius of curvature is less than said second radius of curvature so that said motor-compressors can be positioned closer to said bottom wall.

85. A motor-compressor system as claimed in claim 83 wherein said bottom wall is formed with a substantially flat surface adjacent each of said corner areas having said first radius of curvature.

86. A motor-compressor system as claimed in claim 85 further comprising shell supporting feet affixed to said flat surfaces.

87. A variable capacity motor-compressor system comprising:

(a) a hermetic shell;

(b) a plurality of motor-compressors mounted in said shell, each motor-compressor having a discharge gas fitting in the upper portion thereof;

(c) a discharge port in the top of said shell;

(d) a discharge tube placing each of said discharge fittings in communication with said discharge port; and (e) a body of heat insulting material in the upper interior of said shell for reducing heat transfer from said tubes and the upper portions of said motor-compressors to the lower interior of said shell.

88. A motor-compressor system as claimed in claim 87 wherein said insulating material has a preformed molded configuration.

89. A motor-compressor system as claimed in claim 87 wherein said insulating material is in blanket form.

90. A motor-compressor system as claimed in claim 87 wherein a separate body of said insulating material is provided for each of the motor-compressors disposed within said shell.

* * * * *

UNITED STATES PATENT AND TRADEMARK OFFICE

CERTIFICATE OF CORRECTION

PATENT NO. : 5,385,453 Page 1 of 2

DATED : January 31, 1995

INVENTOR(S) : James F. Fogt and Jean-Luc Caillat

It is certified that error appears in the above-indentified patent and that said Letters Patent is hereby corrected as shown below:

On the title page under Attorney, Agent or Firm, "Perce" should be -- Pierce --.

Column 1, line 39, "assignees'" should be --assignee's--

Column 3, line 18, "communciating" should be -- communicating --.

Column 6, line 10, "polymetric" should be -- polymeric --.

Column 6, line 28, "degress" should be -- degrees --.

Column 7, line 33, delete "compressor".

Column 8, line 15, "herein" should be -- wherein --.

Column 10, line 13, "motor-compressor" should be -- motor-compressors --.

Column 10, line 14, "a" (2nd occurrence) should be --the--

Column 10, line 14, "passes" should be -- passing --.

Column 10, line 18, after "said" insert -- mounting means includes a --.

Column 10, line 18, after "plate" insert -- which --.

Column 10, line 23, delete "disposed adjacent the top of its sleeve and".

Column 10, line 29, after "motor-compressor" insert -- is in part surrounded by a sleeve and --.

UNITED STATES PATENT AND TRADEMARK OFFICE

CERTIFICATE OF CORRECTION

PATENT NO. : 5,385,453 Page 2 of 2

DATED : January 31, 1995

INVENTOR(S) : James F. Fogt and Jean-Luc Caillat

It is certified that error appears in the above-indentified patent and that said Letters Patent is hereby corrected as shown below:

Column 11, line 42, delete "grommet" and substitute therefor -- motor-compressor system --.

Column 11, line 44, delete "grommet" and substitute therefor -- motor-compressor system --.

Column 11, line 51, delete "motor-compressors" and substitute therefor -- motor-compressor --.

Column 12, line 20, after "1" insert -- wherein said motor-compressors are of the welded shell hermetic type, and --.

Column 13, line 24, after "shell;" delete -- and --.

Column 13, line 42, after "therebetween" insert -- defining a sump --.

Column 14, line 29, "insulting" should be -- insulating --.

Signed and Sealed this

Eighteenth Day of July, 1995

*Attest:*

Bruce Lehman

BRUCE LEHMAN

*Attesting Officer*

*Commissioner of Patents and Trademarks*